United States Patent [19]

Stewart

[11] 4,096,299

[45] Jun. 20, 1978

[54] METHOD OF MAKING DECORATIVE CANDLES

[76] Inventor: William E. Stewart, 2375 Williamson Rd., Saginaw, Mich. 48601

[21] Appl. No.: 654,927

[22] Filed: Feb. 2, 1976

[51] Int. Cl.[2] ..... B05D 3/12; B05D 5/06

[52] U.S. Cl. ..... 427/264; 427/261; 427/286; 427/300; 427/358; 427/371; 427/443; 431/126

[58] Field of Search ..... 427/264, 261, 286, 300, 427/358, 371, 443; 264/139, 293, 296; 431/126

[56] References Cited

U.S. PATENT DOCUMENTS

| | | | |
|---|---|---|---|
| 88,779 | 4/1869 | Field et al. | 264/293 X |
| 433,785 | 8/1890 | Harding | 264/293 X |
| 1,596,017 | 8/1926 | Harnisch | 427/264 |
| 2,841,972 | 7/1958 | Weglin | 431/126 X |

*Primary Examiner*—Ronald H. Smith
*Assistant Examiner*—Evan K. Lawrence
*Attorney, Agent, or Firm*—Learman & McCulloch

[57] ABSTRACT

A decorative multicolored candle is produced by applying, to the side surface of a candle core, a removable solid member having a melting temperature higher than that of candle wax. The surface of the core and side member are coated successively with a plurality of superimposed different colored coatings of candle wax, and the solid member is removed through a slit cut in the superimposed coatings, thereby forming projections having multicolored free ends. Thereafter, one of more additional different colored coatings of candle wax are applied over the thus treated core. A sufficient amount of the additional coatings are then removed to expose the multicolored free ends of the projections outlined by the exposed colors of the additional coatings.

1 Claim, 7 Drawing Figures

METHOD OF MAKING DECORATIVE CANDLES

BACKGROUND OF THE INVENTION

This invention relates to the manufacture of decorative candles having multiple color designs.

Decorative candles have been manufactured in many different ways, but not all of the known manufacturing processes are altogether acceptable for a number of reasons. For example, some candles have their outer surfaces coated or painted to produce a selected design, whereas others have paper or other decorative materials applied to the outer surface of such candles following their manufacture. Other candles also are produced by an extrusion or similar process wherein candle wax and a different material are extruded to produce candles having designs formed by the different materials.

Although candles produced by the aforementioned processes may be decorative, it is difficult in many instances to duplicate designs on successive candles and, in addition, the utilization of paints and materials other than candle wax often interferes with or actually precludes burning of such candles.

SUMMARY OF THE INVENTION

Candles produced in accordance with the invention are not subject to the foregoing criticisms for the reasons that a given design can be reproduced quite faithfully on successive candles and all of the materials incorporated in a candle, other than a wick, may be the same.

In accordance with this invention, a decorative multicolored candle is produced by applying, to the side surface of a candle core, a removable solid member having a melting temperature higher than that of candle wax. The surface of the core and side member are coated successively with a plurality of superimposed different colored coatings of candle wax, and the solid member is removed through a slit cut in the superimposed coatings, thereby forming projections having multicolored free ends. Thereafter one or more additional different colored coatings of candle wax are applied over the thus treated core. A sufficient amount of the additional coatings overlying the projections are then removed to expose the multicolored free ends of the projections outlined by the exposed colors of the additional coatings.

BRIEF DESCRIPTION OF THE DRAWING

Apparatus and methods for producing candles according to the invention are disclosed in the accompanying drawings wherein.

DESCRIPTION OF THE PREFERRED EMBODIMENTS

Figure 1:
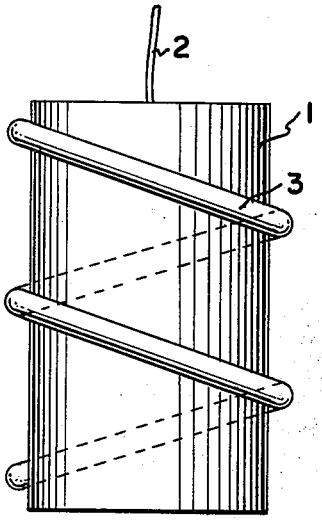
FIG. 1 is an elevational view illustrating a first step in the production of a candle according to the invention.
Figure 2:
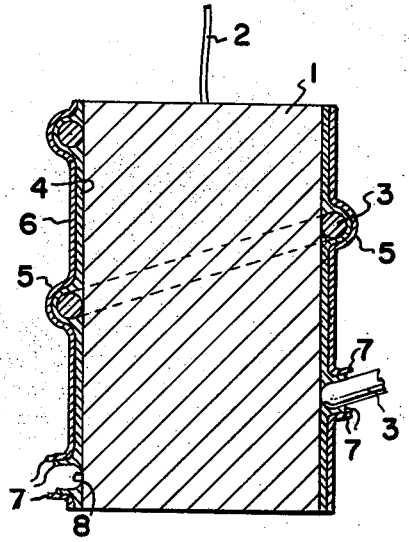
FIG. 2 is a vertical sectional view illustrating a second step of the process.
Figure 3:
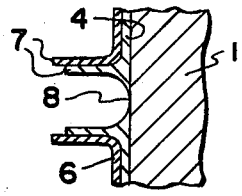
FIGS. 3 and 4 are fragmentary, sectional views of further steps of the process.

A candle produced according to the process illustrated in FIGS. 1 – 3 commences with the formation of a core 1 surrounding a wick 2. The core may be formed by pouring molten candle wax into a hollow mold having a cylindrical, quadrangular, or other desired configuration, the wick 2 being suspended in the mold so as to be enveloped by the wax. The wax of which the core 1 is formed preferably is clear or colorless, although pigmentation may be included in the wax if desired. Following the formation of the core 1, the latter is removed from its mold and may be wrapped spirally with a solid member such as a cord 3 to form a radially extending projection on the side surface of the core, the cord being formed of a material having a melting temperature higher than that of the candle wax. The cord must also be capable of being removed from the side surface after being coated as described subsequently. The wrapped core then may be dipped in a bath of melted candle wax having a color different from that of the core. The temperature of the wax constituting the bath should be sufficiently high to assure that the wax is fluid, but it should not be so high that the wax of the core 1 is melted. Instead, the temperature of the melted wax should be such as to cause it to adhere to the surface of the core 1 so as to completely coat the latter and the cord 3 with a wax layer 4. The layer 4 will have a spiraling projection 5 overlying the cord 3.

There are different kinds of candle wax which have different melting temperatures. The optimum temperature at which the melted wax bath is maintained will approximate 170° F., but the most desirable temperature can be determined empirically.

Following dipping of the core 1 to apply the coating 4, the coating is permitted to cool and solidify. Thereafter, the coated core may be dipped successively in another bath of different colored melted wax to apply a wax layer 6 on the first layer 4. Any selected number of additional coatings of different colored wax may be applied in like manner. Each successive coating will increase the diameter of the core and the diameter of the projection 5 caused by the cord 3.

After a suitable number of coatings have been applied, the projection 5 may be slit by knife. The width of the slit is such as to allow the cord 3 to be pulled through the slit so as to cause the edges of the slit projection to turn outwardly and form projections consisting of the multicolored fingers 7 having free ends as is illustrated in FIG. 2. Between the fingers 7 is a concave groove 8 (FIG. 3) caused by the removal of the cord 3.

Figure 4:
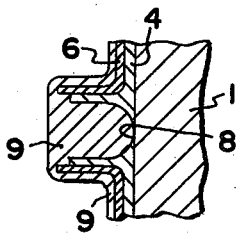

Thereafter the coated core may be dipped a selected number of additional times in melted candle wax of different colors to completely coat not only the previously deposited layers, but also the ends of the fingers 7 and to fill the groove 8. Each additional coating has a color different from that of the immediately adjacent coating. A single additional coating 9 is shown in FIG. 4, but it will be understood that additional coatings may be applied.

Following solidification and cooling of the final coating, the coated core may be subjected to a circumferential skiving process in which the portions of the wax coating overlying the projections are exposed so as to reveal the design. This process may be accomplished by cutting, filing, grinding, melting, or scraping the deposited layers to the desired depth so as to expose the design and form a finished candle of regular shape, e.g., a cylinder.

Figure 5:
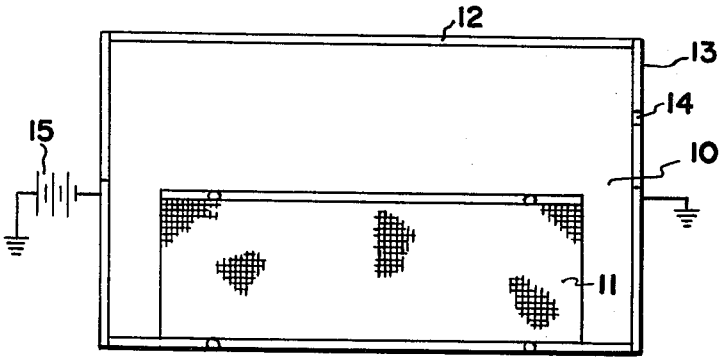
FIG. 5 is a top plan view of apparatus for use in finishing a candle.
Figure 6:
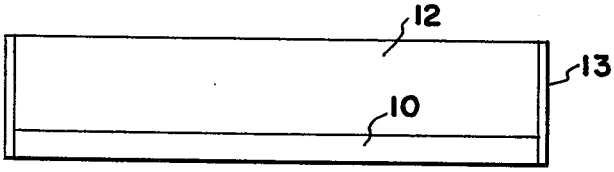
FIG. 6 is an end elevation of the apparatus shown in FIG. 5.
Figure 7:
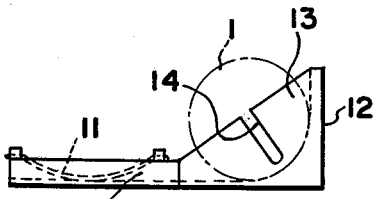
FIG. 7 is a side elevation of the apparatus.

The aforementioned skiving process is accomplished by apparatus such as that disclosed in FIGS. 5 – 7 comprising a tray 10 having adjacent one end a concave screen 11 the length of which is at least as great as that of the layered core. Adjacent the other end of the tray is an upstanding, smooth wall 12. At one end of the wall is an upstanding, smooth plate 13 having a diagonal slot 14 therein. The plates and the screen preferably are of electrically conductive materials so that they may be heated electrically by means of a battery or other source of energy 15 grounded at one terminal and connected at its other terminal to the tray 10 which, in turn, is grounded. Alternatively, the tray could be heated in any other manner.

In the use of the apparatus, the layered core is placed on the screen 11 and is rotated so as to enable the screen to shave material from the outer surface of the layered core. When sufficient wax has been removed from the layered core to expose the outturned fingers 7, such fingers will describe a helical stripe having the colors of the individual fingers, whereas the portions of the candle body between the convolutions of the stripe will have the color of the last applied wax layer therebetween. Between the fingers of each stripe, the wax in the groove 8 will form another stripe.

The candle then may be finished by rolling it on the tray 10 against the surfaces of the members 12 and 13, the wick 2 extending through the slot 14. While rolling the candle, the end adjacent the member 13 may be pressed against the latter so as to provide a smooth surface. Following the finishing of the outer surface at one end of the candle, the candle may be reversed and rolled with its opposite end against the member 13 so as to smooth the latter.

If desired, the finished candle then may be polished or coated with a thin layer of clear wax or a slightly tinted wax so as to alter the finished appearance of the candle.

If the core 1 is formed of clear or colorless wax, lighting of the wick 2 will enable some of the light from the flame to be transmitted through the clear core to the design formed on the side of the finished candle. Interesting and aesthetic lighting effects thus can be produced.

The disclosed embodiments are presently preferred forms of the invention, but are intended to be illustrative rather than definitive thereof. The invention is defined in the claims.

I claim:

1. A method of making a multicolored candle comprising (a) forming a candle wax core; (b) applying to the side surface of said core a removable solid member projecting outwardly from said surface, said member having a melting temperature higher than that of said candle wax, and said member being removable from said surface in subsequent step (e); (c) completely coating said surface and said applied member successively with a plurality of superimposed different colored coatings of candle wax, each of said superimposed coatings having a color different from that of the immediately underlying coating; (d) cutting a slit extending through said coatings to said member, said slit having a width permitting formation, in subsequent step (e), of projections upon removal of said member through said slit; (e) removing said member through said slit, removal of said member deflecting the superimposed coatings on opposite sides of said slit outwardly of said surface to form, on each said opposite side, a projection consisting of the said superimposed coatings, whereby the free end of each said projection forms a multicolored design; (f) thereafter applying at least one additional coating of candle wax to the thus treated core to completely coat said coated surface and projections and to fill the space between said projections formerly occupied by said solid member, each said additional coating having a color different from that of the coating immediately adjacent thereto; and (g) removing a sufficient amount of the said additional coatings overlying said projections to expose the free ends of the projections and to form said multicolored design outlined by the exposed colors of each said additional coating.

* * * * *